US008082771B2

(12) United States Patent
Song et al.

(10) Patent No.: US 8,082,771 B2
(45) Date of Patent: Dec. 27, 2011

(54) ADJUSTABLE HYDRAULIC PRESS WITH BOTH UPPER AND LOWER DOUBLE ACTION

(75) Inventors: Yuquan Song, Changchun (CN); Minghui Wang, Changchun (CN); Xiaofang Guan, Changchun (CN)

(73) Assignee: Jilin University, Changchun, Jilin Province (CN)

( * ) Notice: Subject to any disclaimer, the term of this patent is extended or adjusted under 35 U.S.C. 154(b) by 1033 days.

(21) Appl. No.: 10/589,151

(22) PCT Filed: Feb. 4, 2005

(86) PCT No.: PCT/CN2005/000158

§ 371 (c)(1), (2), (4) Date: Dec. 27, 2007

(87) PCT Pub. No.: WO2005/080070

PCT Pub. Date: Sep. 1, 2005

(65) Prior Publication Data

US 2008/0098908 A1 May 1, 2008

(30) Foreign Application Priority Data

Feb. 23, 2004 (CN) ..... 2004 1 0010699

(51) Int. Cl.
*B21J 9/12* (2006.01)
*B21J 13/04* (2006.01)

(52) U.S. Cl. ..... 72/453.02; 72/455

(58) Field of Classification Search ..... 72/350, 72/351, 453.01, 453.02, 453.03, 453.07, 72/455, 456; 100/269.01, 918
See application file for complete search history.

(56) References Cited

U.S. PATENT DOCUMENTS

| | | | | |
|---|---|---|---|---|
| 3,668,920 | A * | 6/1972 | Grankowski et al. | 72/455 |
| 4,295,358 | A * | 10/1981 | Bulmer | 72/453.06 |
| 4,457,684 | A | 7/1984 | Gram | |
| 4,571,979 | A | 2/1986 | Baba et al. | |
| 5,823,104 | A | 10/1998 | Beisel et al. | |
| 6,520,075 | B1 | 2/2003 | Shinoda et al. | |
| 2002/0134256 | A1 * | 9/2002 | Futamura et al. | 100/269.01 |

FOREIGN PATENT DOCUMENTS

| | | | |
|---|---|---|---|
| CN | 87209840 | U | 4/1988 |
| CN | 2590684 | Y | 12/2003 |

* cited by examiner

*Primary Examiner* — Debra Sullivan
(74) *Attorney, Agent, or Firm* — Merchant & Gould P.C.

(57) ABSTRACT

The present invention discloses an adjustable hydraulic press with both upper and lower double action, specially suitable for the cylindrical gear formed by stamping or expanding, closed forging and the metal cold forming or metal hot forming of punching, finishing, flanging and drawing of sheet materials. The press comprises four columns, an upper beam, a main slide block, a hold down slide block, a fixing worktable, a floating worktable and a lower beam. A hydraulic chamber a of master cylinder fixed in the upper beam communicates to a hydraulic chamber of an auxiliary cylinder, a plunger of the master cylinder is connected to the main slide block and drives it. A hydraulic chamber of a gas-liquid power accumulator fixed in the main slide block communicates to a hydraulic chamber of a hold down cylinder, a plunger of the hold down cylinder is connected to the hold down slide block and drives it. A plunger of an ejecting cylinder fixed in the lower beam is connected to the floating worktable and drives it. The hydraulic press of the invention simplifies the hydraulic system of the existing hydraulic, improves utilization rate of energy, production efficiency and working accuracy of workpiece.

10 Claims, 6 Drawing Sheets

ADJUSTABLE HYDRAULIC PRESS WITH BOTH UPPER AND LOWER DOUBLE ACTION

FIELD OF THE INVENTION

The present invention relates to a hydraulic press used in the field of plastic forming, especially to an adjustable hydraulic press with both upper and lower double action suitable for cylindrical gear formed by the compound forming of stamping and expanding, closed forging and metal cold forming or metal hot forming of punching, finishing, flanging and drawing of sheet material.

BACKGROUND OF THE INVENTION

Hydraulic press plays a quite important role in the plastic forming field of modem manufacture. The hydraulic press as shown in FIG. 14 is an existing typical hydraulic press, which can fulfill double action in the upside and single-action in the underside. Such hydraulic press comprises a liquid filled cylinder 64, a master cylinder 65, an upper beam 66, a hold down cylinder 67, a main slide block 68, a hold down slide block 69, a control device 70, a hydraulic system 71, a worktable 72 and an ejecting cylinder 73. It fulfills hold down operation by the hold down slide block 69 on the top of the worktable 72 and deforms a workpiece by the main slide block 68. There is only the ejecting cylinder 73 in the underside of the worktable, and the ejecting cylinder 73 can only eject the workpiece, but can not fulfill a hold down operation in an opposite direction at the same time. For the compound forming of stamping and expanding, closed forging, the drawing of sheet materials, finishing, trimming, punching, flanging and their compound technique, in order to simplify work steps and improve work efficiency, stock utilization and forming accuracy of the workpiece, they need to be finished on a hydraulic press with both upper and lower double action, so will increase the structural complexity and manufacturing cost. Furthermore, some technical problems need to be resolved.

SUMMARY OF THE INVENTION

The object of the invention is to overcome the above-mentioned problems and to provide an adjustable hydraulic press with both upper and lower double action that can fulfill the forming operation with upper and lower hold down, so can reduce manufacture cost and improve production efficiency. Furthermore, it is easy to be operated and suitable for the technique requirements of the compound forming process.

The above object of the invention can be achieved by using an adjustable hydraulic press with both upper and lower double action which will be described as follows in conjunction with the drawings.

An adjustable hydraulic press with both upper and lower double action comprises a main body and a hydraulic system, wherein the main body comprises a column 8, an upper beam 1 and a lower beam 21 respectively fixed on upper and lower ends of the column 8, a main slide block 9 and a hold down slide block 13 sliding fit with the column 8, a fixing worktable 14 and a floating worktable 15 installed on the column 8, a plunger 6 of a master cylinder 2 fixed on the upper beam 1 and plungers 7 of four auxiliary cylinders 5 fixed on the upper beam 1 are connected to the main slide block 9 and drive it, a hydraulic chamber of a gas-liquid power accumulator 11 fixed in the main slide block 9 communicates to a hydraulic chamber of a hold down cylinder 10 fixed in the main slide block 9 by a connecting pipe 32, the plunger 12 of the hold down cylinder 10 is connected to the hold down slide block 13 and drives it, tools and moulds or ejecting mould can be fixed on an upper surface of a plunger 22 of a ejecting cylinder, a snap ring groove 23 is provided at an upper end of the plunger 22 of the ejecting cylinder in order to move the floating worktable, a snap ring can be mounted in the snap ring groove 23 or removed from it, after loading the snap ring, the plunger 22 of the ejecting cylinder can eject the floating worktable 15 to a predetermined height.

The fixing worktable 14 is located between the hold down slide block 13 and the floating worktable 15, the floating worktable 15 is located between the fixing worktable 14 and the lower beam 21, the floating worktable 15 sliding fits with the column 8, a ejecting cylinder 17 is fixed on the lower beam 21, the plunger 22 of the ejecting cylinder 17 passes through a center hole of the floating worktable 15.

An air pressure of an high pressure nitrogen 35 in an gasbag 34 of the gas-liquid power accumulator 11 fixed on the main slide block 9 balances with the hydraulic pressure of high pressure oil 33 in the hydraulic chamber of the gas-liquid power accumulator, the pressure of the high pressure oil balances with the hydraulic pressure of the hold down cylinder 10 by the connecting pipe 32, a charge valve 36 and a pressure gauge interface 37 are fixed on the gas-liquid power accumulator 11.

The master cylinder 2 and the four auxiliary cylinders 5 are fixed in the upper beam 1, upper and lower hydraulic chambers of the master cylinder 2 and the four auxiliary cylinders 5 are respectively connected to each other through a connecting pipe 28 and a connecting pipe 29, the master cylinder 2 is equipped with a load hydraulic pipe 3 which doubles as a backstroke discharged pipe and a backstroke hydraulic pipe 4 which doubles as an load discharged pipe, the load hydraulic pipe 3 and the backstroke hydraulic pipe 4 are connected to a high pressure liquid source, the backstroke discharged pipe 3 and the load discharged pipe 4 are connected to a tank.

Four resetting slide rods 24 of the hold down slide block 13 pass through the main slide block 9, a position-limiting nut 2 connected to the resetting slide rod 24 by screw thread is used to adjust the maximal space between a two slide blocks.

After installing the snap ring in the snap ring groove 23, the plunger 22 of the ejecting cylinder can elevate the floating worktable 15 to a predetermined height and the floating worktable 15 is locked by a position-limiting nut 16 for the floating worktable nut.

Water-cooling jackets 27, 26, 30, 31, 18 are respectively installed on outerwalls of the master cylinder 2, the auxiliary cylinder 5, the hold down cylinder 10, the gas-liquid power accumulator 11 and the ejecting cylinder 17, a spiral separator plate 59 is provided in every water-cooling jacket, a connecting pipe 57 and a connecting pipe 58 are respectively provided at upper and lower ends of the water-cooling jacket 31 of the gas-liquid power accumulator and the water-cooling jacket 30 of the hold down cylinder, a connecting pipe 62 and a connecting pipe 61 are respectively provided at upper and lower ends of the water-cooling jacket 27 of the master cylinder and the water-cooling jacket 26 of the auxiliary cylinder.

A water inlet 60 and a water outlet 61 are provided at the upper and lower ends of the water-cooling jacket 27 of the master cylinder respectively, a water inlet 55 and a water outlet 56 are provided at the upper and lower ends of the water-cooling jacket 31 of the gas-liquid power accumulator respectively, a water inlet and a water outlet are provided at the upper and lower ends of the water-cooling jacket 18 of the hold down cylinder respectively, all water inlets of the water-cooling jackets are connected to water outlets of a cooling system, and all water outlets of the water-cooling jackets are connected to water inlets of the cooling system.

The gasbag 34 of the gas-liquid power accumulator 11 can be replaced by a piston 39 and a seal ring 40.

There is a main slide block between the upper beam and the hold down slide block in the invention. The plungers of the hold down cylinders fixed in the main slide block are connected to the hold down slide block and drive it. The ejecting cylinder is fixed on the lower beam. The fixing worktable is set between the hold down slide block and the floating worktable sliding fit with the columns. The invention characterized by: there are four symmetrical and uniformly distributed auxiliary cylinders around the master cylinder in the upper beam, the upper and lower hydraulic chambers of the master cylinder and auxiliary cylinders are respectively connected by the connecting pipe; Two gas-liquid power accumulators and four hold down cylinders are set in the main slide block, the high pressure oil chamber of each gas-liquid power accumulator is connected to the hydraulic chambers of every two hold down cylinders by the connecting pipe; By virtue of the snap ring installed in the plunger of the ejecting cylinder, the floating worktable can be driven to the predetermined height and fixed by the nuts; the resetting slide rods of hold down slide block is set between the main slide block and the hold down slide block, the nuts screwed at the end of resetting slide rods can adjust the maximal distance between two slide blocks, and the load hydraulic pipes and backstroke hydraulic pipes of the main cylinder and the ejecting cylinder are connected to the hydraulic circuit of the hydraulic system, there are hydraulic chamber with high pressure oil and gasbag with high pressure nitrogen in the gas-liquid power accumulator, and high pressure oil and high pressure nitrogen are isolated by the gasbag or by the piston.

There are T-type slots machined to fix moulds at the lower surfaces of the main slide block and the hold down slide block, at the upper and lower surfaces of the fixing worktable, and at the upper surface of the floating worktable. An upper male mould is installed on the lower surface of the main slide block and an upper hold down mould is installed on the lower surface of the hold down slide block, a lower male mould is fixed on the end surface of plunger of the ejecting cylinder, a lower hold down mould is fixed on the upper surface of the floating worktable, and a concave die is fixed on the upper surface of the fixing worktable.

The adjustable hydraulic press with both upper and lower double action in the invention can be used to process cylindrical spur gear. The concrete forming process is as follows: The upper male mould 43 is installed into a punch shank 41, then fixed on the lower surface of the main slide block 9. The upper hold down mould 44 is installed into the upper hold down die sleeve 45 and fastened on the lower surface of the hold down slide block 13. The concave die 47 is fastened on the upper surface of the worktable 14 and lower male mould 50 is fixed on the plunger of the ejecting cylinder 22. The lower hold down mould (which doubles as a workpiece-ejecting mould) 51 is fastened on the upper surface of the floating worktable 15. After installing the snap ring into the snap ring groove 23, move the plunger 22 of the ejecting cylinder upward, so as to drive the hold down mould 51 upward into the concave die 47 a little, then screw up the location-limiting nut 16 and remove the snap ring from the snap ring groove 23. After loading a cylindrical blank or a gear blank 46 into the concave die 47, startup the hydraulic press. The main slide block 9 and the hold down slide block 13 move downward at the same time. When the hold down mould 44 touches with the gear blank 46, the hold down slide block 13 stop moving down, then the plunger 22 of the hold down cylinder moves upward, and the upper male mould 43 and the lower male mould 50 press into the center of the gear blank 46 at the same time, when the gear blank is expanded, the forming process is finished. In the course of the backstroke, the main slide block 9 lifts up, the plunger 22 continues to move upward, the ejecting mould 51 ejects the gear and the resetting slide rods 24 pull the hold down slide block 13 to the initial position. The plunger 22 of the ejecting cylinder moves back and the spur gear is drop off from the lower male mould 50. Finally, the entire process of stamping and expanding is finished.

The profitable effects of the invention are listed as follows:

The press has novel design, simple structure, high utilization rate of energy, good function, high production efficiency, low cost and is easy to operate. Furthermore, the hydraulic press can be used in both metal hot forming and metal cold forming. Hence, there is a good application foreground and market prospect for the invention.

1. Due to the upper compound forming structure of the master cylinder and the hold down cylinders, the lower compound forming structure of the floating worktable and the ejecting cylinder and adjustable blank holder pressures, the structure of hydraulic press is greatly simplified, and it is suitable for compound forming of stamping and expanding, trimming and punching, finishing and bending, forward and reverse drawing with upper and lower hold down, and so on. Therefore, it reforms and exploits the functions of the existing hydraulic press.

2. Due to the structure of the master cylinder, the hold down cylinders and the gas-liquid power accumulators as well as the resetting slide rods of the hold down slide block, the hydraulic system and its control system of the load and backstroke of the hold down slide block are saved; Owing to the structure of the ejecting cylinder and the adjustable floating worktable, the hydraulic system and its control system of the lower hold down is saved. Therefore, the hydraulic system and its control system of the hydraulic press are greatly simplified, the energy waste is reduced and the utilization ratio of energy is increased.

3. It can save raw materials and special hydraulic elements, shorten manufacturing cycle of the hydraulic press, and reduce the cost of manufacture of the hydraulic press.

4. It can improve the precision of the workpiece and the production efficiency, and has no special technical requirements for the operators.

5. It has little strike and shake, and brings no environmental pollution.

BRIEF DESCRIPTION OF THE DRAWINGS

In FIGS. 1-13, the reference number 1 represents an upper beam, the reference number 2 represents a master cylinder, the reference number 3 represents a load hydraulic pipe, which doubles as a backstroke discharged pipe, the reference number 4 represents a backstroke hydraulic pipe, which doubles as an load discharged pipe, the reference number 5 represents a auxiliary cylinder, the reference number 6 represents a plunger of the mater cylinder, the reference number 7 represents a plunger of the auxiliary cylinder, the reference number 8 represents a column, the reference number 9 represents a main slide block, the reference number 10 represents a hold down cylinder, the reference number 11 represents a gas-liquid power accumulator, the reference number 12 represents a plunger of the hold down cylinder, the reference number 13 represents a hold down slide block, the reference number 14 represents a fixing worktable, the reference number 15 represents a floating worktable, the reference number 16 represents a position-limiting nut for the floating worktable, the reference number 17 represents a ejecting cylinder, the reference number 18 represents a water-cooling jacket of the ejecting cylinder, the reference number 19 represents a load hydraulic pipe of the ejecting cylinder which doubles as an unload pipe for backstroke, the reference number 20 represents a backstroke hydraulic pipe of the ejecting cylinder which doubles as an unload pipe, the reference number 21 represents a lower beam, the reference number 22 represents a plunger of the ejecting cylinder, the reference number 23 represents a snap ring groove for elevating the floating worktable, the reference number 24 represents a resetting slide rod of the hold down slide block, the reference number 25 represents a position-limiting nut for the reseting slide rod 24, the reference number 26 represents a water-cooling jacket of the auxiliary cylinder, the reference number 27 represents a water-cooling jacket of the master cylinder, the reference number 28 represents a connecting pipe between the upper hydraulic chamber of the master cylinder 2 and that of the auxiliary cylinder 5, the reference number 29 represents a connecting pipe between the lower hydraulic chamber of the master cylinder 1 and that of the auxiliary cylinder 5, the reference number 30 represents a water-cooling jacket of the hold down cylinder 10, the reference number 31 represents a water-cooling jacket of the gas-liquid power accumulator 11, the reference number 32 represents a connecting pipe between the hydraulic chamber of the gas-liquid power accumulator 11 and the hold down cylinder 10, the reference number 33 represents the high pressure oil, the reference number 34 represents an gasbag, the reference number 35 represents the high pressure nitrogen, the reference number 36 represents a charge valve, the reference number 37 represents a pressure gauge or pressure sensor interface, the reference number 38 represents an exhaust hole, the reference number 39 represents a piston separating the gas from the liquid, the reference number 40 represents a seal ring, the reference number 41 represents a punch shank of the upper male mould, the reference number 42 represents a clip sleeve of the upper male mould, the reference number 43 represents the upper male mould, the reference number 44 represents an upper hold down mould, 45 represents a clip sleeve of the upper hold down mould, 46 represents a gear blank, the reference number 47 represents a concave die, the reference number 48 represents a prestressing sleeve of the concave die, the reference number 49 represents a clip sleeve of the concave die, the reference number 50 represents a lower male mould, the reference number 51 represents a lower hold down mould double as the ejecting mould of the workpiece, the reference number 52 represents a clip sleeve of the lower hold down mould, the reference number 53 represents a clip sleeve of the lower male mould, the reference number 54 represents a compression bolt, the reference number 55 represents a water inlet of the water-cooling jacket of the power accumulator, the reference number 56 represents a water outlet of the water-cooling jacket of the power accumulator, the reference number 57 represents an upper connecting pipe between the power accumulator and the hold down cylinder, the reference number 58 represents a lower connecting pipe between the power accumulator and the hold down cylinder, the reference number 59 represents a spiral separator plate of the water-cooling jacket, the reference number 60 represents a water inlet of the water-cooling jacket of the master cylinder, the reference number 61 represents a water outlet of the water-cooling jacket of the master cylinder, the reference number 62 represents an upper connecting pipe between the master cylinder and the auxiliary cylinder, the reference number 63 represents a lower connecting pipe between the master cylinder and the auxiliary cylinder.

DETALIED DESCRIPTION OF THE PREFERRED EMBODIMENT

Figure 1:
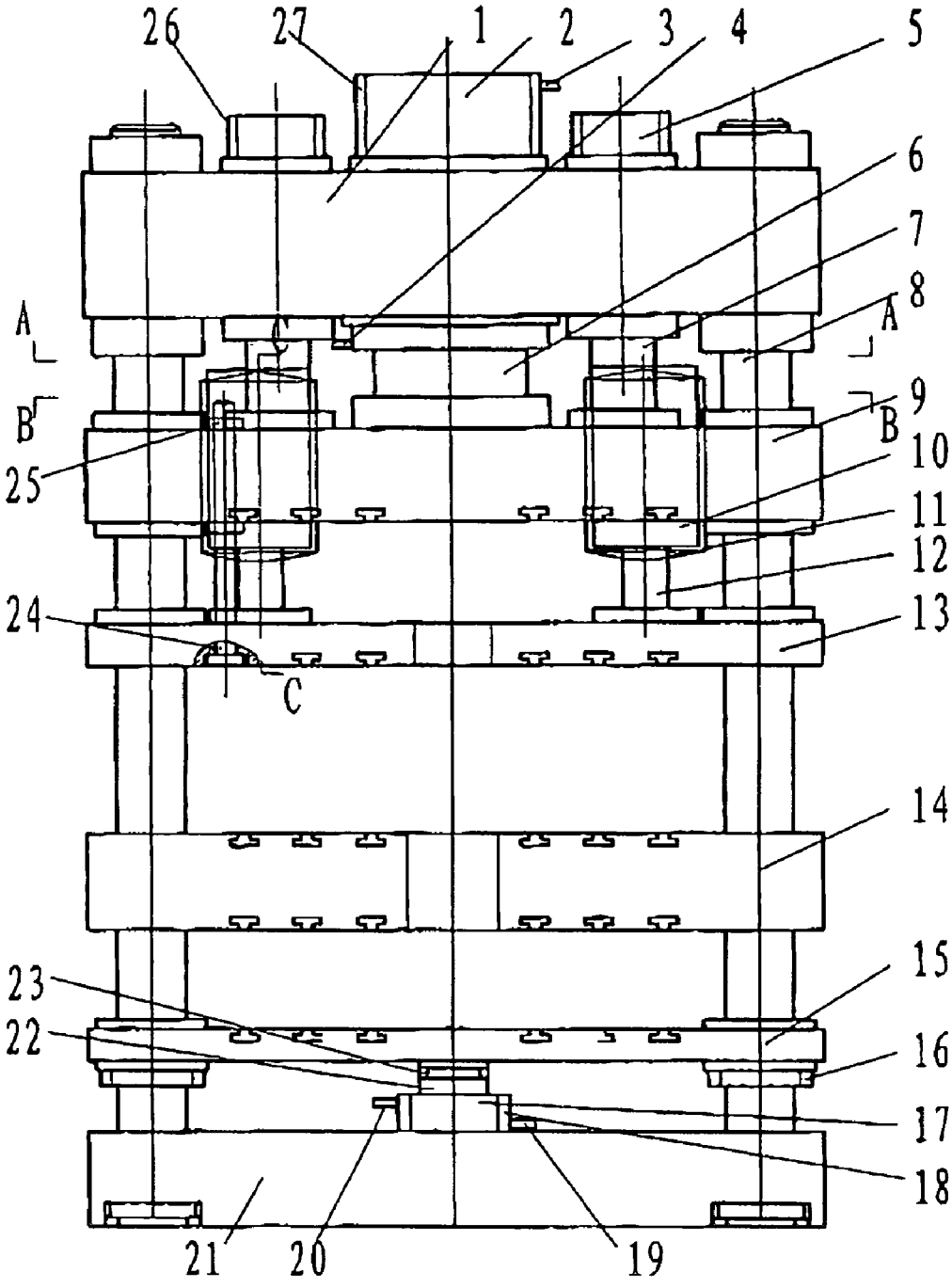
FIG. 1 is a front view of the hydraulic press of the invention.

The detailed structure of the invention will be described hereinafter with reference to an exemplified embodiment as shown in the accompanying drawings.

Referring to FIGS. 1-4, a four-column type adjustable hydraulic press with both upper and lower double action is shown, wherein an upper beam 1, a main slide block 9, a hold down slide block 13, a worktable 14, a floating worktable 15 and a lower beam 21 pass through four columns 8 and are fixed on the four columns 8. The upper beam 1, the worktable 14 and the lower beam 21 are fastened on the columns 8 with nuts. It must be ensured that the overall structure of the press has enough strength and rigidity. The main slide block 9 and the hold down slide block 13 situate between the upper beam 1 and worktable 14, sliding fits with the columns 8, and ensures a good quality of fit and wearability. The floating worktable 15 situate between the worktable 14 and the lower beam 21, also sliding fits with the columns 8, and the position-limiting nut 16 is able to limit the floating worktable on a predetermined height. There are T-slots used for fixing the tools and moulds on the lower surfaces of the main slide block 9 and the hold down slide block 13, the upper and lower surface of the worktable 14 and the upper surface of the floating worktable 15. The master cylinder 2 is fixed on the center of the upper beam 1, and four auxiliary cylinders 5 are symmetrically installed around the master cylinder 2. The lower ends of the plunger 6 and the plungers 7 are connected to the main slide block 9. The upper hydraulic chambers of the master cylinder 2 and the auxiliary cylinder 5 are communicated with each other by the oil pipe 28, and the lower hydraulic chambers of the master cylinder 2 and the auxiliary cylinders 5 are communicated with each other by the oil pipe 29. The load hydraulic pipe 3 (which doubles as a backstroke discharged pipe) and the backstroke hydraulic pipe 4 (which doubles as a load discharged pipe) are set on the master cylinder 2 and are communicated with the oil circuit in the hydraulic system. Four resetting slide rod 24 slide fit with the main slide block 9 and pass through four holes on the main slide block, and the lower ends thereof are respectively fixed on the hold down slide block, and the upper ends thereof have limit nuts 25. Four hold down cylinders 10 are fixed in the main slide block 9, and the lower ends of the plungers 12 thereof are connected to the hold down slide block 13. A gas-liquid power accumulator 11 is fixed between every two hold down cylinders 10 to communicate with the oil circuit of the two hold down cylinders.

An ejecting cylinder 17 is fixed on the lower beam 21, and the plunger 22 of the ejecting cylinder 17 passes through a central hole of the floating worktable 15. Tools and dies can be installed on the upper end surface of the plunger 22, and on the outer edge of the top of the plunger 22, a snap ring is installed for elevating the floating worktable 15. A hydraulic pipe for loading 19 (which doubles as a unload pipe for backstroke) is installed on the lower hydraulic chamber of the ejecting cylinder 17, and a hydraulic pipe for backstroke 20 (which doubles as an unload pipe for loading) is installed on the upper hydraulic chamber of the ejecting cylinder 17.

Figure 5:
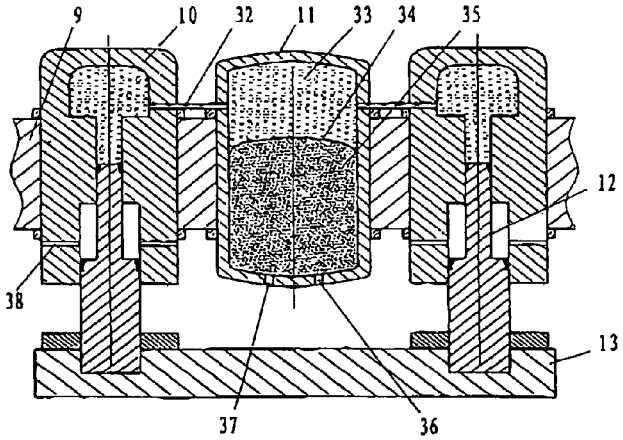
FIG. 5 is a sectional view taken along the line C-C in FIG. 1.
Figure 6:
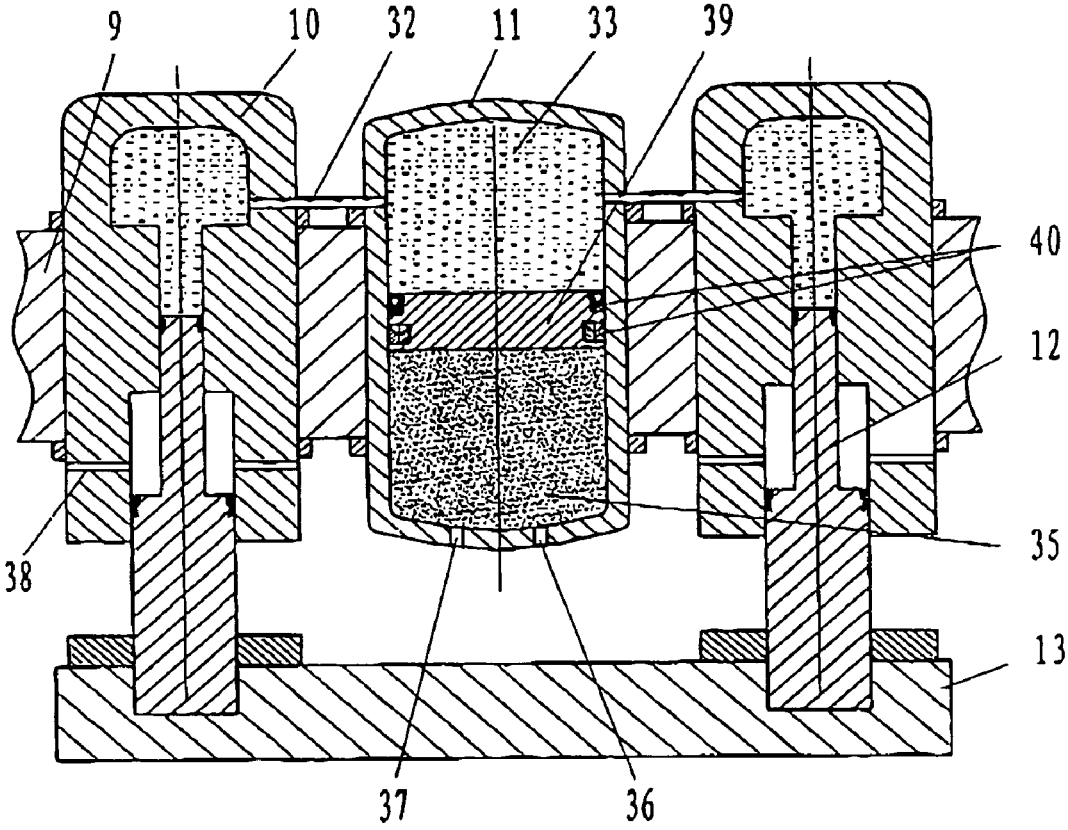
FIG. 6 is a sectional view taken along the line B-B in FIG. 1 with a piston, instead of an gasbag.

As shown in FIGS. 1, 5 and 6, two gas-liquid power accumulators 11 and four hold down cylinders 10 are fixed on the main slide block 9, and the gas-liquid power accumulator 11 has a hydraulic chamber filled with high pressure oil 33 and an gasbag 34 filled with high pressure nitrogen 35. The hydraulic chamber of each gas/liquid power accumulator is communicated with the hydraulic chambers of every two hold down cylinders by the connecting pipe 32. A gas/liquid separator piston 39 can replace the gasbag 34 of the hydraulic chamber and separate liquid from gas by a seal ring 40.

The four-column type hydraulic press as mentioned above can also be designed to be a frame type as required. On the hydraulic press of frame type with better overall strength and rigidity, both the main slide block versus the hold down slide block and the dovetail on the floating slide block versus the dovetail groove on the frame sliding fit with each other, and the precision of the hydraulic press can be ensured by adjusting the adjustment screws to alter the clearance between the dovetails and the dovetail grooves. The hydraulic press, whether four-column type or frame type, is suitable for the case of cold plastic deformation.

For the case of hot plastic deformation, the sealability of the seal ring between the plunger and the cylinder would be degraded since the workpiece in an elevated temperature transfers heat to the plunger through the mould. Therefore, as shown in FIGS. 1, 2, 3 and 4, the water-cooling jackets 18, 26, 27, 30 and 31 are respectively installed on the outer wall of the ejecting cylinder 17, the auxiliary cylinder 5, the master cylinder 2, the hold down cylinder 10 and the gas-liquid power accumulators 11; as shown in FIGS. 10-13, a connecting water pipe 57 is provided for communicating the water-cooling jacket 31 of each gas/liquid power accumulator to the water-cooling jackets 30 of two hold down cylinders, and a connecting water pipe 62 is provided for communicating the water-cooling jacket 27 of the master cylinder to the water-cooling jackets 26 of four auxiliary cylinders. An inlet 60 is provided above the water-cooling jacket 27 of the master cylinder, and an outlet 61 is provided below the water-cooling jacket 27 of the master cylinder, An inlet 55 and an outlet 56 are provided above and below the water-cooling jacket 31 of the gas/liquid power accumulator respectively, and an inlet and an outlet are provided above and below the water-cooling jacket 18 of the ejecting cylinder respectively. There is a spiral separator plate in each water-cooling jacket. The above inlets are connected to the outlets of the circulating cooling system, and the above outlets are connected to the inlets of the circulating cooling system.

The operating principle of the hydraulic press of the invention is described as follows:

Under the control of the hydraulic control system of the master cylinder, the high pressure oil firstly gets into the upper hydraulic chambers of the master cylinder 2 and the auxiliary cylinder 5 respectively through the load pipe 3 and the connecting pipe 28, then drives the slide block 9 to move downward by pushing the plunger 6 of the master cylinder and the plunger 7 of the auxiliary cylinder. At the same time, the oil in the lower hydraulic chamber of the auxiliary cylinder 5 gets into the lower hydraulic chamber of the master cylinder 2 and goes back to the tank respectively through the connecting pipe 29 and the load discharged pipe 4. During the backstroke, the high pressure oil gets into the lower hydraulic chambers of the master cylinder and the auxiliary cylinder and raises the main slide block 9 up, and the oil in the upper hydraulic chambers of the master cylinder and the auxiliary cylinders goes back to the tank through the backstroke discharged pipe 3. Due to the communication between the high pressure oil 33 of the gas-liquid power accumulator 11 and the hold down cylinder through the connecting pipe 32, the pressure of the high pressure nitrogen 35 in the gasbag 34 balances with the oil pressure in the hold down cylinder 10 and the oil pressure of the high pressure oil 33. Therefore, the hold down slide block 13 moves down in step with the master slide block 9. The master slide block 9 can only overcome the elasticity of the high pressure nitrogen 35 in the gasbag 34 and move downward relative to the hold down slide block when the hold down slide block 13 is holding down. The resetting slide rod 24 of the hold down cylinder is connected to the hold down slide block 13 by its lower end and passed through the four holes on the main slide block 9. There is a position-limiting nut 25 on its upper end. When the main slide block 9 goes back, the resetting slide rod 24 pulls the hold down slide block 13 back to its initial position. The ejecting cylinder 17 is fixed on the lower beam 21. There is a load pipe 19 and an unload pipe 20 on the lower hydraulic chamber and the upper hydraulic chamber of the ejecting cylinder 17 respectively. A snap ring groove 23 used to elevate the floating worktable 15 is provided on a plunger 22 fixed in the ejecting cylinder 17. When the high pressure oil gets into the lower hydraulic chamber of the ejecting cylinder 17 through the load pipe 19, the plunger 22 is rejected, and the oil in the upper hydraulic chamber of the ejecting cylinder 17 goes back to the tank through the unload pipe 20. Contrarily, when the high pressure oil gets into the upper hydraulic chamber of the ejecting cylinder 17 through the unload pipe 20 and pushes the plunger 22 back, the oil in the lower hydraulic chamber goes back to the tank through the unload pipe 19.

The production examples by applying the hydraulic press of the invention is described as follows:

There are many long-standing serious problems in the machining of cylindrical gear: the material utilization and the production efficiency are low; the impact toughness of the gear is reduced because the metal fibers of the dedendum are cut, and so on. The material utilization and the production efficiency can be improved by using the existing hydraulic press to process them, but there are also many problems should be solved: the corners of the cylindrical gear are under filling; there are cracks at the dedendum; the short service life of the concave mold. All these problems are caused by the direction of the forming force being vertical to that of the material flowing during the gear forming.

Figure 7:
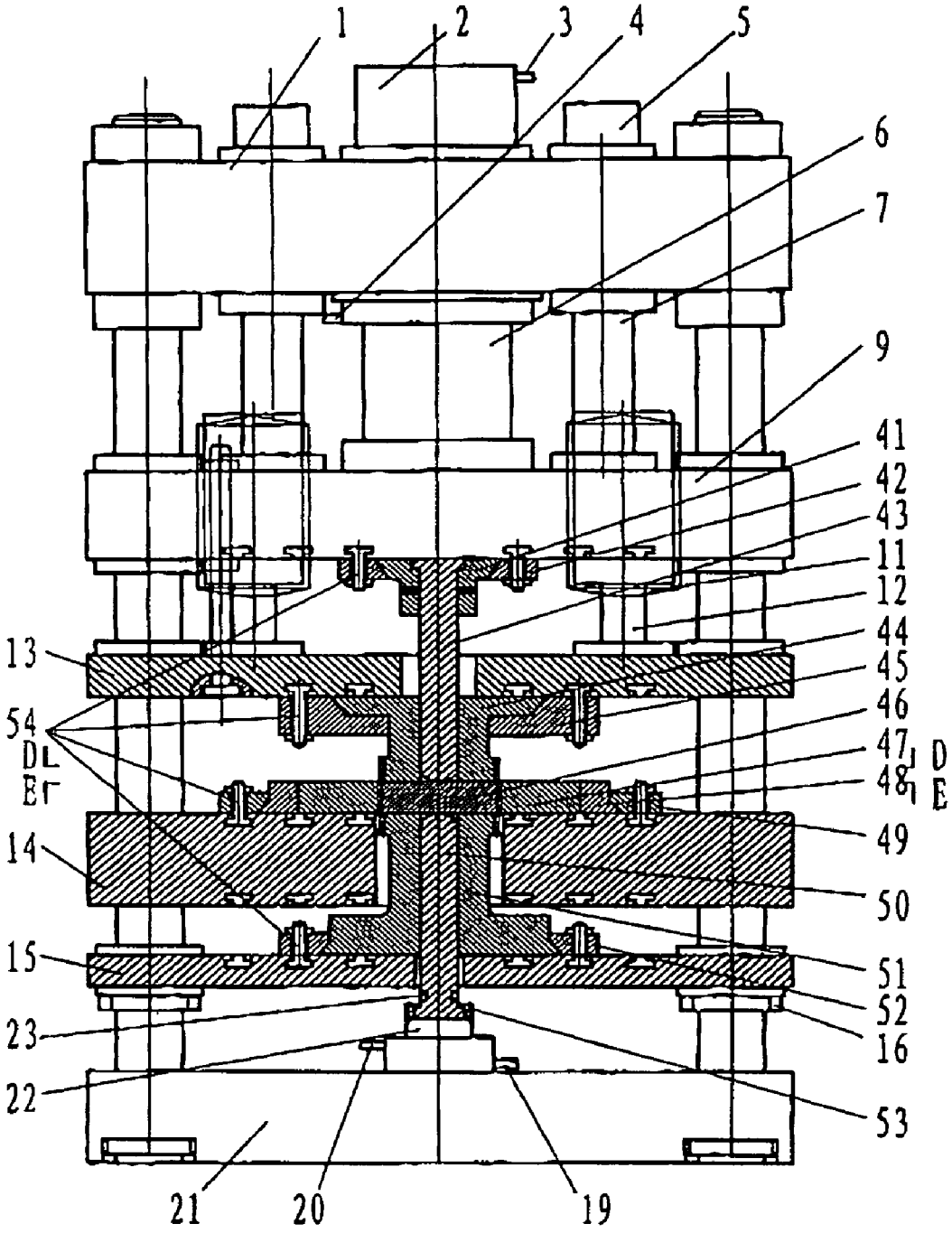
FIG. 7 is a die-setting drawing of compound precision forming of spur gears by stamping and expanding.
Figure 8:
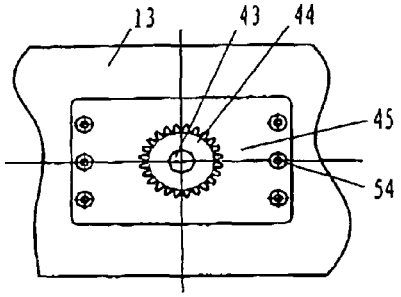
FIG. 8 is a sectional view taken along the line D-D in FIG. 7.
Figure 9:
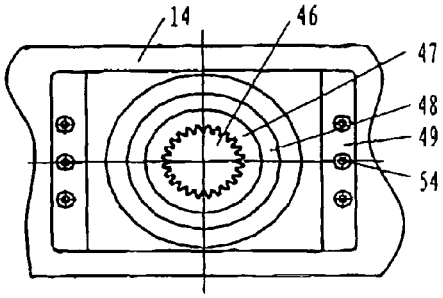
FIG. 9 is a sectional view taken along the line E-E in FIG. 7.
Figure 10:
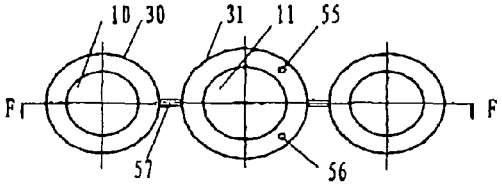
FIG. 10 is a top view of the power accumulator and the pure water cooling device of the hold down cylinders.
Figure 11:
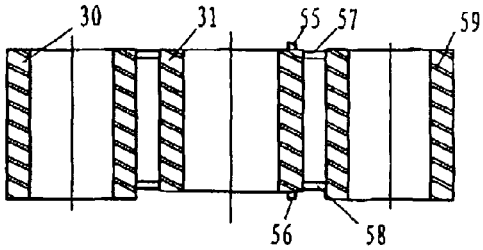
FIG. 11 is a sectional view taken along the line F-F in FIG. 10.
Figure 12:
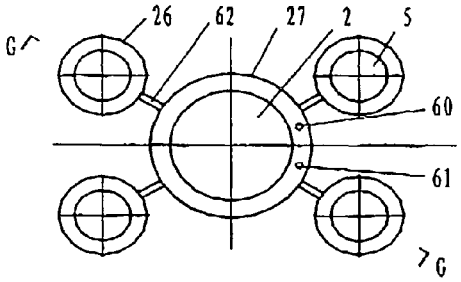
FIG. 12 is a top view of the water-cooling jackets of the master cylinder and the auxiliary cylinders.
Figure 13:
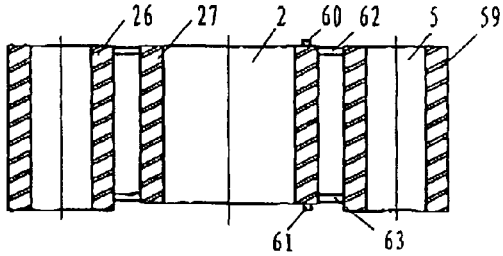
FIG. 13 is a sectional view taken along the line G-G in FIG. 12.
Figure 14:
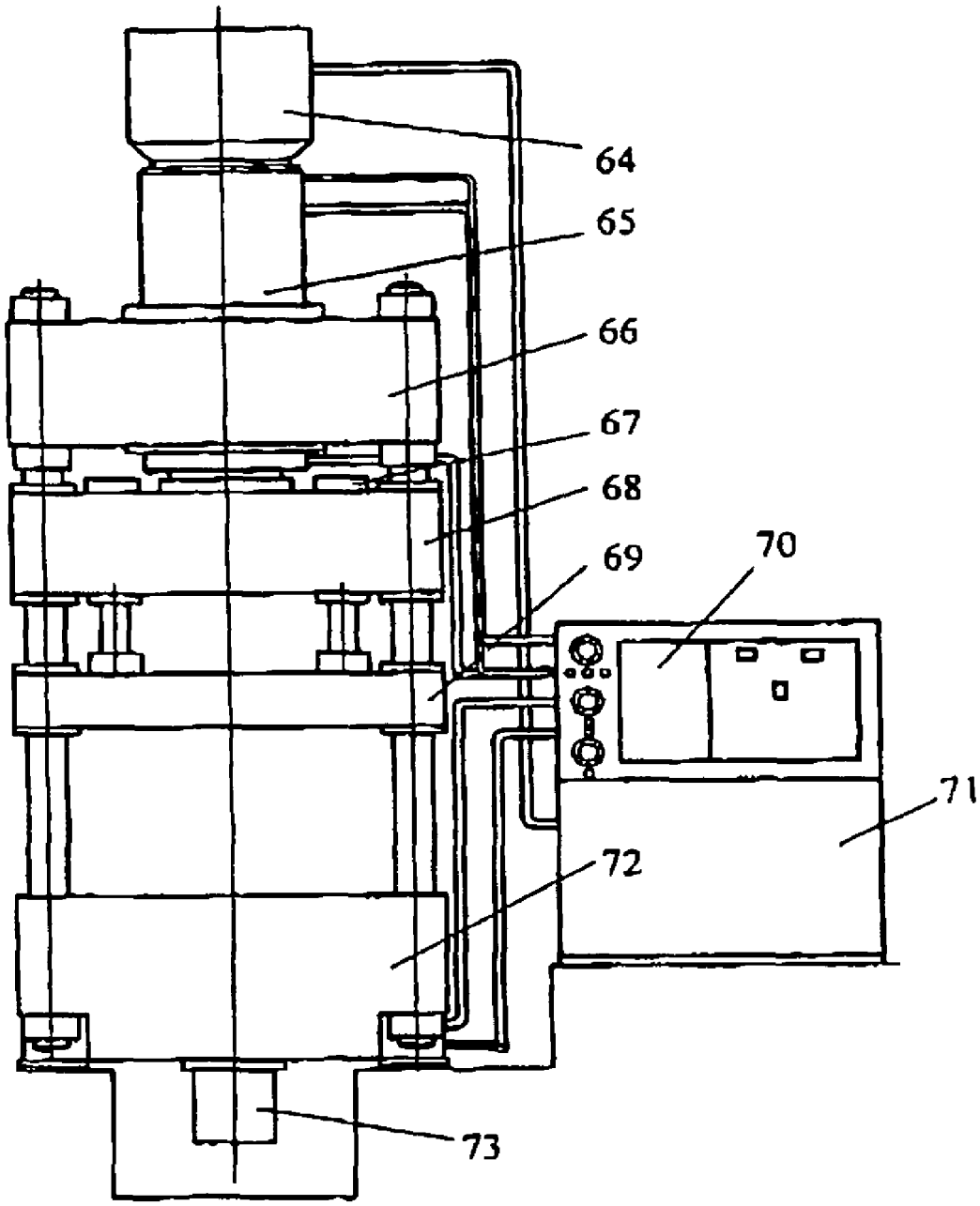
FIG. 14 is a front view of the existing hydraulic press.

Now an example showing how to form the cylindrical gear by stamping and expanding using the hydraulic press of the invention will be described with reference to FIGS. 7, 8 and 9. Firstly, the upper male mould 43 is loaded into the upper expanding punch shank 41, then the upper expanding punch shank 41 is loaded into the compression sleeve of the upper male mould 42 and fixed on the lower surface of the main slide block 9 by the compression bolt 54. The upper hold down mould 44 is loaded into the upper hold down mould sleeve 45 and fixed on the lower end of the hold down slide block 13 by the compression bolt 54. The concave mold 47 with a prestressing sleeve 48 is loaded into the compression sleeve 49 of the concave mold and fixed onto the fixing worktable 14 by the compression bolt 54. The lower male mould 50 is loaded into the compression sleeve 53 of the lower male mould and fixed onto the plunger 22 of the ejecting cylinder. The lower hold down mould (which doubles as an ejecting mould 51) into the compression sleeve 52 of the lower hold down mould and fixed onto the floating worktable 15 by the bolt 54. The snap ring is putted into the snap ring groove 23 used to elevate the floating worktable and drive the plunger 22 of the ejecting cylinder. When the lower hold down mould 51 begins to enter the concave mold 47, stop the plunger 22 and fasten the position-limiting bolt 16 of the floating worktable, then remove the snap ring from the snap ring groove 23.

The copper or aluminum cylindrical spur gear or small diameter steel cylindrical spur gear can be processed directly by the cylindrical blank. To make large diameter steel cylindrical gear, the blank should be rolled firstly. During the process of forming, the gear blank 46 is loaded into the concave mold 47 firstly and then the hydraulic press is turn on. The main slide block 9 begins to move downward. Due to the elastic effect of the gasbag of the gas-liquid power accumulator 11 on the plunger 12 of the hold down cylinder, the hold down slide block 13 moves downward in step with the main slide block 9. When the hold down mould 44 begins to enter the concave mold 47 and contacts with the gear blank 46, the hold down slide block 13 stops and the main slide block 9, which overcome the elasticity resulted from the gas-liquid power accumulator 11, keeps on moving downward, under the action of the upper hold down mould 44 and the lower hold down mould 51, when the gear blank 46 is deformed by stamping. The main slide block 9 keeps on moving downward, and meanwhile the plunger 22 of the lower hold down cylinder move upward. Under the action of the upper male mould 43 and the lower male mould 50, the gear blank 46 is deformed by expanding at its center. Now the process of the plastic forming of the cylindrical gear is finished. During the backstroke, the main slide block 9 raises up and the plunger 22 of the ejecting cylinder keeps moving upward. The ejecting mould 51 ejects the finished gear. The resetting slide rod 24 of the hold down slide block draws back the hold down slide block 13 to its initial position. The plunger 22 of the ejecting cylinder also returns and the lower male mould 50 departs from the finished gear. Now the whole process of the compound precision forming of stamping and expanding for the cylindrical gear is finished.

Because of the compound forming of stamping and expanding as mentioned above, the gear blank is deformed by stamping both on the upper surface and the lower surface. The direction of expanding force from the upper and lower male moulds is consistent with that of the plastic flowing during the gear forming. Therefore, the problems such as the corners of the cylindrical gear are underfilled, there are cracks at the dedendum and the short service life of the concave mold are solved.

Figure 2:
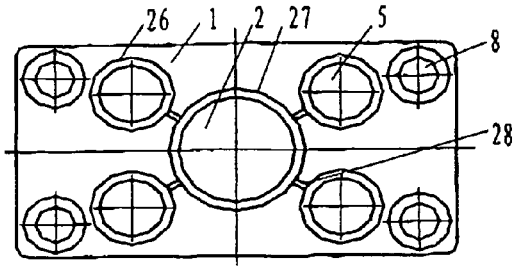
FIG. 2 is a top view of FIG. 1.
Figure 3:
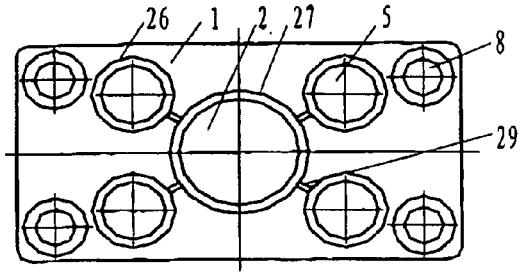
FIG. 3 is a sectional view taken along the line A-A in FIG. 1.

The notable technical effects of the invention are listed as follows:

1. With reference to FIGS. 1, 2 and 3, it can be seen that the master cylinder is fixed at the center of the upper beam 1; the four auxiliary cylinders 5 are symmetrically fixed on the upper beam 1 around the master cylinder; the plunger 6 of the master cylinder and the plunger 7 of the auxiliary cylinder are both fixed on the main slide block 9 by their lower ends; the upper hydraulic chamber of the master cylinder 2 communicates to the upper hydraulic chambers of the four auxiliary cylinders by the connecting pipe 28, the lower hydraulic chamber of the master cylinder 2 communicates to the upper hydraulic chambers of the four auxiliary cylinders by the connecting pipe 29. When beginning to load, the load high pressure oil enters into the upper hydraulic chamber of the master cylinder 2 through the load pipe 3, and enters into the upper hydraulic chambers of the auxiliary cylinders 5. It moves the main slide block 9 downward by synchronously driving the plunger 6 of the master cylinder and the plunger 7 of the auxiliary cylinder. During the backstroke, the unload high pressure oil enters into the lower hydraulic chamber of the master cylinder 2 through the backstroke hydraulic pipe 4, and enters into the lower hydraulic chambers of the auxiliary cylinders 5. It resets the main slide block 9 by synchronously driving the plunger 6 of the master cylinder and the plunger 7 of the auxiliary cylinder. All these simplify the structures of the load/unload hydraulic system and the hydraulic control system.

Figure 4:
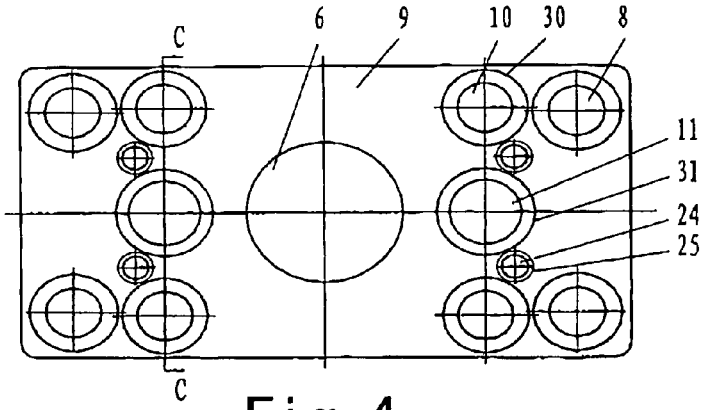
FIG. 4 is a sectional view taken along the line B-B in FIG. 1.

2. With reference to FIGS. 1 and 4, it can be seen that four hold down cylinders 10 are fixed on the main slide block 9 symmetrically; lower ends of four plungers 12 of the four hold down cylinders are fixed on the hold down slide block 13; between every two hold down cylinders, there is a gas-liquid power accumulator 11 with an gasbag 34 and a high pressure oil 33 in it; the high pressure oil in the gas-liquid power accumulator 11 communicates to the hydraulic chamber of the hold down cylinder 10 by the connecting pipe 32; the high pressure nitrogen in the gasbag 34 acts its pressure on the high pressure oil 33, then the high pressure oil 33 acts on the plunger 12 of the hold down cylinder through the connecting pipe 32. When the main slide block 2 moves downward relative to the hold down slide block 13, the plunger 12 of the hold down cylinder compresses the gasbag 34 to produce the pressure used to hold down. As a result, the hydraulic control system and the hydraulic system required by the hold down slide block can be omitted. The pressure of the high pressure nitrogen 35 in the gasbag 34 is measured by the pressure gauge or the pressure sensor mounted at the interface 37. The charge valve 36 can charge preset high pressure nitrogen 35 into the gasbag 34. The pressure of the nitrogen in the gasbag 34 is changed by the movement of the plunger 12 of the hold down cylinder. Besides, the dependency of the pressure of the nitrogen in the gasbag 34 on the stroke of the plunger 22 of the hold down cylinder can be designed by the ratio of the constringent volume of the gasbag to the whole volume of the gasbag.

3. With references to FIGS. 5 and 6, it can be seen that the gasbag 34 of the gas-liquid power accumulator 11 can be replaced by the piston 39; the high-powered seal ring 40, which is fixed on the outerwall of the piston 39, isolates the high pressure nitrogen 35 from the high pressure oil 33. It can perform the same function as mentioned above.

4. With reference to FIG. 1, it can be seen that the four resetting slide rods 24 are connected to the hold down slide block 13 by their lower ends and pass through the four holes on the main slide block 9 by their upper end; there are nuts 25 to fix the positions thereof on their upper ends. When the main slide block 9 gets back, the four resetting slide rods 24 pull back the hold down slide block 13 to its initial position. It can simply the hydraulic system used to control the hold down cylinder, and can omit the hydraulic system and the hydraulic control system required by the hold down cylinder during its backstroke.

5. With reference to FIG. 1, it can be seen that the floating worktable 15, which is under the fixing worktable 14, sliding fits with the column 8. When adjusting the mould, load the lower hold down mould onto the floating worktable 15 firstly, then put the snap ring into the snap ring groove 23 of plunger 22 of ejecting cylinder. The floating worktable is ejected by the plunger 22 of the ejecting cylinder. When the lower hold down mould 51 begins to enter the concave mold 47, fasten the bolt 16 of the floating worktable 15 to fix the floating worktable and take out the snap ring. It can omit the hydraulic system and the hydraulic control system required by the lower hold down process.

The invention claimed is:

1. An adjustable hydraulic press with both upper and lower double action comprising a main body and a hydraulic system, wherein the main body comprises a column, an upper beam and a lower beam fixed on upper and lower ends of the column, a main slide block and a hold down slide block sliding fit with the column, and a fixing worktable and a floating worktable fixed on the column, characterized in that a plunger of a master cylinder fixed on the upper beam and plungers of four auxiliary cylinders fixed on the upper beam are connected to the main slide block and drive it, a hydraulic chamber of a gas-liquid power accumulator fixed in the main slide block communicates to a hydraulic chamber of a hold down cylinder fixed in the main slide block by a connecting pipe, a plunger of the hold down cylinder is connected to the hold down slide block and drives it, tools and moulds or ejecting mould can be fixed on an upper surface of a plunger of a ejecting cylinder, a snap ring groove is provided at an upper end of the plunger of the ejecting cylinder to elevate the floating worktable, a snap ring can be mounted in the snap ring groove or removed from it, after loading the snap ring, the plunger of the ejecting cylinder can eject the floating worktable to a predetermined height.

2. The adjustable hydraulic press with both upper and lower double action according to claim 1, wherein the fixing worktable is located between the hold down slide block and the floating worktable, the floating worktable is located between the fixing worktable and the lower beam, the floating worktable sliding fits with the column, the ejecting cylinder is fixed on the lower beam, the plunger of the ejecting cylinder can pass through a center hole of the floating worktable.

3. The adjustable hydraulic press with both upper and lower double action according to claim 1, wherein an air pressure of a high pressure nitrogen in a gasbag of the gas-liquid power accumulator fixed on the main slide block balances with a hydraulic pressure of high pressure oil in the hydraulic chamber of the gas-liquid power accumulator, the pressure of the high pressure oil balances with the hydraulic pressure of the hold down cylinder by the connecting pipe, a charge valve and a pressure gauge interface are fixed on the gas-liquid power accumulator.

4. The adjustable hydraulic press with both upper and lower double action according to claim 1, wherein the master cylinder and the four auxiliary cylinders are fixed in the upper beam, upper and lower hydraulic chambers of the master cylinder and the four auxiliary cylinders are connected to each other through a connecting pipe and a connecting pipe respectively, the master cylinder is equipped with a load hydraulic pipe, which doubles as a backstroke discharged pipe and a backstroke hydraulic pipe, which doubles as a load discharged pipe, the load hydraulic pipe and the backstroke hydraulic pipe are connected to a high pressure liquid source, the backstroke discharged pipe and the load discharged pipe are connected to a tank.

5. The adjustable hydraulic press with both upper and lower double action according to claim 1, wherein resetting slide rod of the hold down slide block pass through the main slide block, a position-limiting nut connected to the resetting slide rod by screw thread is used to adjust a maximal space between the two slide blocks.

6. The adjustable hydraulic press with both upper and lower double action according to claim 1, wherein after installing the snap ring in the snap ring groove, the plunger of the ejecting cylinder can elevate the floating worktable to a predetermined height and the floating worktable is locked by a position-limiting nut for the floating worktable.

7. The adjustable hydraulic press with both upper and lower double action according to claim 1, wherein water-cooling jackets are installed on outerwalls of the master cylinder, the auxiliary cylinder, the hold down cylinder, the gas-liquid power accumulator and the ejecting cylinder respectively, a spiral separator plate is provided in each water-cooling jacket, a connecting pipe is provided at an upper end and a connecting pipe is provided at a lower end of the water-cooling jacket of the gas-liquid power accumulator and the water-cooling jacket of the hold down cylinder respectively, a connecting pipe is provided at an upper end and a connecting pipe is provided at lower end of the water-cooling jacket of the master cylinder and the water-cooling jacket of the auxiliary cylinder respectively.

8. The adjustable hydraulic press with both upper and lower double action according to claim 7, wherein a water inlet and a water outlet are provided at upper and lower ends of the water-cooling jacket of the master cylinder respectively, a water outlet and a water inlet are provided at the upper and lower ends of the water-cooling jacket of the gas-liquid power accumulator respectively, a water inlet and a water outlet are provided at the upper and lower ends of the water-cooling jacket of the hold down cylinder respectively, all water inlets of the water-cooling jackets are connected to water outlets of a cooling system, and all water outlets of the water-cooling jackets are connected to water inlets of the cooling system.

9. The adjustable hydraulic press with both upper and lower double action according to claim 3, wherein the gasbag of the gas-liquid power accumulator can be replaced by a piston and a seal ring.

10. The adjustable hydraulic press with both upper and lower double action according to claim 1, wherein it is used to process cylindrical spur gear.

* * * * *